US008463668B2

(12) United States Patent
Youssef et al.

(10) Patent No.: US 8,463,668 B2
(45) Date of Patent: Jun. 11, 2013

(54) SYSTEM AND METHOD OF MANAGING BOTH INSTANT AND ONLINE LOTTERY TICKET SALES

(75) Inventors: Ayman Adib Youssef, Hopkinton, MA (US); Moneer Guirguis, Natick, MA (US)

(73) Assignee: Rabbit Technology, Inc., Framingham, MA (US)

( * ) Notice: Subject to any disclaimer, the term of this patent is extended or adjusted under 35 U.S.C. 154(b) by 1221 days.

(21) Appl. No.: 11/977,411

(22) Filed: Oct. 24, 2007

(65) Prior Publication Data

US 2009/0149239 A1 Jun. 11, 2009

Related U.S. Application Data

(60) Provisional application No. 60/853,884, filed on Oct. 24, 2006.

(51) Int. Cl.
*G07B 17/00* (2006.01)
*A63F 9/24* (2006.01)

(52) U.S. Cl.
USPC ..... 705/30; 463/17

(58) Field of Classification Search
USPC ..... 705/30
See application file for complete search history.

(56) References Cited

U.S. PATENT DOCUMENTS 5,223,698 A 6/1993 Kapur
5,239,165 A 8/1993 Novak
5,288,976 A 2/1994 Citron et al.
6,105,871 A 8/2000 Campo et al.
6,223,163 B1 4/2001 Van Luchene
6,230,926 B1 5/2001 Schafer et al.
6,351,688 B1 2/2002 Nichols et al.
6,364,206 B1 4/2002 Keohane
6,405,924 B1 6/2002 Shah
6,838,977 B2 1/2005 Chen et al.
6,887,153 B2 5/2005 Walker et al.
7,072,850 B1 7/2006 Van Luchene
7,563,167 B2 * 7/2009 Walker et al. ..... 463/25
2001/0045456 A1 11/2001 Smith
2004/0059659 A1 * 3/2004 Safaei et al. ..... 705/35
2004/0193464 A1 9/2004 Szrek et al.
2005/0059463 A1 3/2005 Gilmore et al.
2005/0178831 A1 8/2005 Sherrod
2005/0269405 A1 12/2005 Throckmorton et al.
2006/0100008 A1 * 5/2006 Wright et al. ..... 463/17
2006/0111956 A1 * 5/2006 Whitesage ..... 705/8
2007/0108669 A1 * 5/2007 Kalthof et al. ..... 264/563
2008/0256099 A1 * 10/2008 Chodorov et al. ..... 707/100

* cited by examiner

*Primary Examiner* — Garcia Ade
(74) *Attorney, Agent, or Firm* — Kriegsman & Kriegsman

(57) ABSTRACT

A lottery accounting system includes a system management bureau that is electronically linked with a plurality of independent lottery vendors, each vendor being preferably supplied with a handheld compute device. In use, the compute device is programmed by the system management bureau to receive selected ticket information from every active instant lottery ticket book offered for sale by the vendor and, in turn, calculate gross instant lottery ticket sales made by the vendor during a specified period. The compute device is also programmed to calculate the compiled net revenue of instant and online lottery ticket sales accrued during a particular time period and, in turn, reconcile the compiled net revenue with the actual amount of cash collected by the vendor. The resultant data can then be reviewed by authorized personnel to track cash discrepancies.

13 Claims, 7 Drawing Sheets

SYSTEM AND METHOD OF MANAGING BOTH INSTANT AND ONLINE LOTTERY TICKET SALES

CROSS-REFERENCE TO RELATED APPLICATIONS

The present application claims the benefit under 35 U.S.C. 119(e) of U.S. provisional Patent Application Ser. No. 60/853,884, filed Oct. 24, 2006, the disclosure of which is incorporated herein by reference.

BACKGROUND OF THE INVENTION

The present invention relates generally to the field of inventory control and more particularly to the management of both instant and online lottery ticket sales.

Lottery vendors (e.g., convenience stores, supermarkets, gas stations, gift shops, bars, restaurants and liquor stores) traditionally offer for sale both instant lottery tickets and online lottery tickets.

Instant lottery tickets (also commonly known in the art as scratch tickets or scratch cards) are typically constructed from a semi-rigid cardboard card that is at least partially covered with a removable coating. As part of the game, the user is required to scratch off the removable coating (e.g., using a coin, fingernail or other similar instrument). With the coating removed, printed matter provided on the card instantly notifies the user whether he/she has won a particular prize (e.g., cash).

Online lottery tickets (also commonly referred to as the daily lottery or jackpot lottery) are typically printed at the point of purchase and include, among other things, a plurality of selected numbers. As part of the game, a single supervised drawing is undertaken at a predetermined time to establish the winning numbers for the particular game. If the purchaser has the winning numbers printed on his/her ticket, he/she is entitled to a particular prize upon redemption. This type of lottery ticket is commonly referred to in the art as an online lottery ticket because the register used to print the customer ticket transmits the particulars of the ticket sale to a central database for the entity managing the drawing.

Due to the growing popularity of all types of lottery games, it has become increasingly difficult for individual lottery vendors to adequately manage (i.e., track, audit) the large quantity of daily lottery sales. In particular, instant tickets are presently provided in a large number of different game formats (e.g., as representing a particular sport, slot machine, etc.) and at various prices to purchase (e.g. $1, $2, $5, $10). For each game, a plurality of individual cards are typically manufactured and sold to vendors as a single book (each ticket being sequentially identified with a unique numbering code), wherein individual cards can be removed from the remainder of the book by tearing along a preformed line of perforation. As can be appreciated, it has been found that certain vendors often have as many as one hundred instant ticket books available for purchase at the same time.

Online lottery ticket sales are traditionally managed in an automatic fashion by the register used to print the online lottery tickets. However, the traditional means for managing (i.e., tracking, accounting) instant ticket sales is through the use of manually-maintained instant ticket inventory logs. An inventory log may include, among other things, (1) the name and/or code associated with the particular game, (2) the book number associated with each active game book, (3) the purchase price of each ticket in each game book, (4) the number/code associated with the next available ticket in each game book at the beginning and end of each employee shift, (5) the money in vendor register at the beginning and end of each employee shift, and (6) information relating to winning tickets that have been redeemed.

It has been found that maintaining a manual log for a large quantity of active instant ticket books is considerably burdensome and time-consuming for a lottery vendor to undertake (often taking as long as 60-120 minutes to complete per shift). Furthermore, because cash received from online lottery tickets and instant lottery tickets is commonly co-mingled into a common register, means for accurately managing each form of lottery sales is rather demanding. However, it should be noted that the accurate daily management of lottery sales is essential in order to deter against ticket theft (e.g., by unscrupulous employees).

SUMMARY OF THE INVENTION

It is an object of the present invention to provide a system and method for managing both instant and online lottery ticket sales.

It is another object of the present invention to provide a system and method as described above which automatically calculates the net revenue accumulated from both instant and online lottery ticket sales within a defined period of time.

It is yet another object of the present invention to provide a system and method as described above which automatically reconciles the calculated net revenue accumulated within the defined period of time with the net cash collected.

It is still another object of the present invention to provide a system and method as described above which takes into account frequent lottery-related gaming updates.

It is yet still another object of the present invention to provide a system and method as described above which is neither burdensome nor time-consuming to use.

Accordingly, as one feature of the present invention, there is provided a method of managing both instant and online lottery ticket sales during a defined period of time using a programmable compute device, the method comprising the steps of (a) inputting instant and online lottery ticket sales data for the defined period of time into the compute device, (b) calculating the compiled net revenue of instant and online lottery ticket sales for the defined period of time using the instant and online lottery ticket sales data, (c) entering the actual net revenue of instant and online lottery ticket sales collected during the defined period of time into the compute device, and (d) reconciling the compiled net revenue with the actual net revenue using the compute device.

Various other features and advantages will appear from the description to follow. In the description, reference is made to the accompanying drawings which form a part thereof, and in which is shown by way of illustration, an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE PREFERRED EMBODIMENT

Lottery Accounting System

Figure 1:
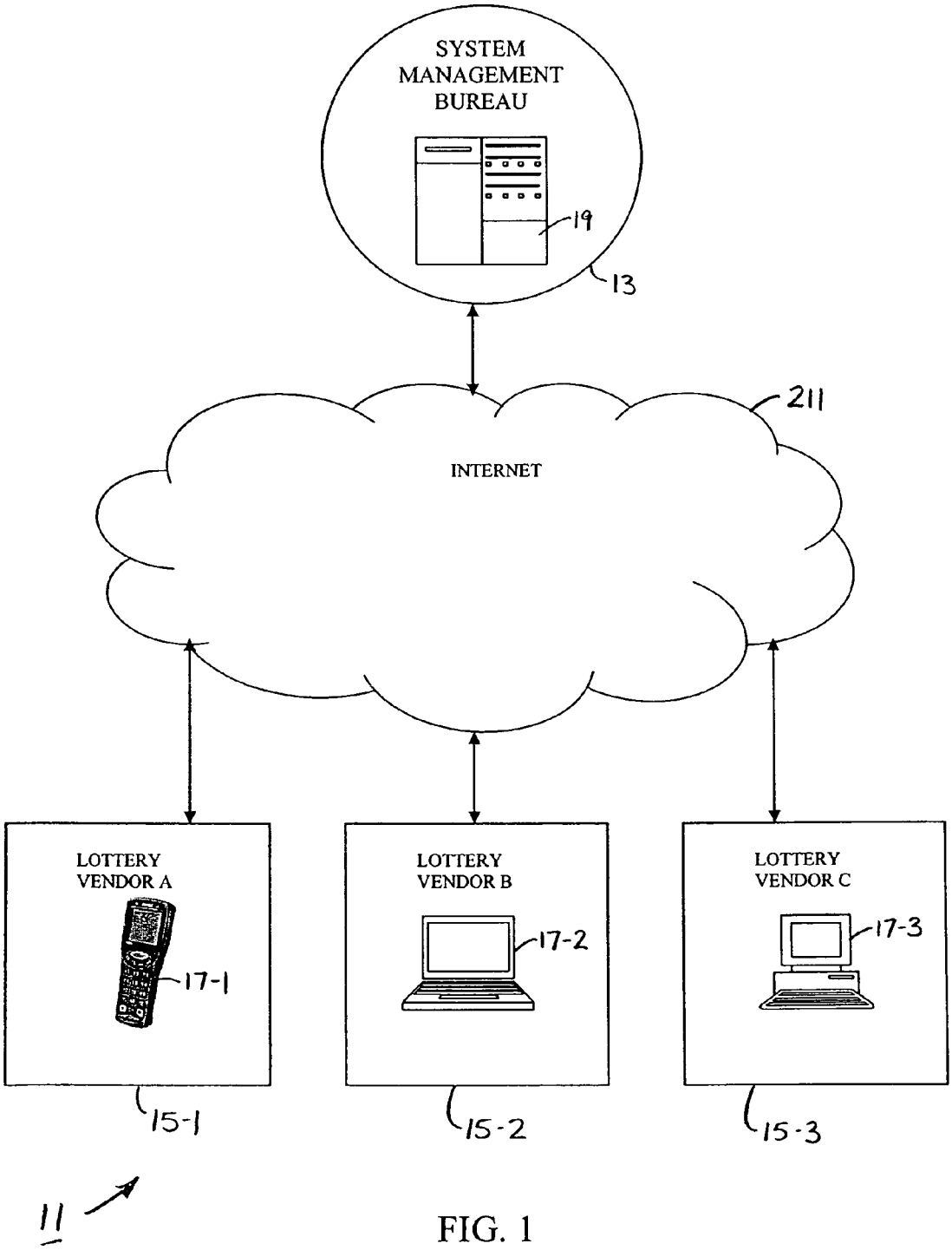
FIG. 1 is a simplified block diagram of a system for managing both instant and online lottery ticket sales, the system being constructed according to the teachings of the present invention.

Referring now to FIG. 1, there is shown a simplified block diagram of a lottery accounting system for managing both instant and online lottery ticket sales, the system being constructed according to the teachings of the present invention and identified generally by reference numeral 11. As will be described in detail below, lottery accounting system 11 provides lottery vendors with means to both (i) facilitate the compilation of instant and online lottery sales data during specified periods of time (e.g., during regular sales clerk shifts) and (ii) automatically reconcile the compiled sales results with the actual cash collected at the end of each specified time period, which is highly desirable.

System 11 comprises a system management bureau 13 and a plurality of lottery vendors 15-1, 15-2 and 15-3.

Each lottery vendor 15 represents any place of business that traditionally offers for sale both instant lottery tickets and online lottery tickets (e.g., convenience stores, supermarkets, gas stations, gift shops, bars, restaurants and liquor stores). As will be described in detail below, each vendor 15 is provided with a compute device 17 programmed with lottery accounting software that manages both instant and online lottery ticket sales during defined periods of time.

System management bureau 13 represents a business entity that is responsible for overseeing the general use of the lottery accounting software of the present invention by the various vendors 15. Accordingly, it is to be understood that system management bureau 13 may be responsible for, among other things, providing each vendor 15 with (i) use of a particular type of compute device 17, (ii) maintenance and/or repair of the supplied compute device 17, (iii) customer support relating to use of the lottery accounting software, (iv) software patches and/or (v) gaming updates (e.g., information pertaining to new lottery games offered within a particular state).

It is to be understood that software patches and lottery game updates can be electronically sent on a routine basis from a server 19 located at bureau 13 to each compute device 17 via internet 21, which is highly desirable. Preferably, each vendor 15 specifies its principal place of business during the initial registration of the accounting software with system management bureau 13. In this manner, vendor 15 is ensured to receive only those gaming updates that correspond to the state in which vendor 15 conducts business.

Lottery vendor 15-1 is shown herein using a highly portable compute device 17-1 to run the lottery accounting software of the present invention. Specifically, handheld compute device 17-1 represents any well-known handheld data collection terminal that can be programmed with the accounting software of the present invention. Preferably, programmable compute device 17-1 includes a display screen (e.g., a color display touch screen), automatic data entry means (e.g., a barcode scanner), manual data entry means (e.g., keyboard and/or touch screen), print means and communication means (e.g., a wireless transceiver). For example, the portable compute device may be in the form of a MC3000 series programmable compute device that is manufactured and sold by Symbol Technologies, Inc. of Holtsville, N.Y.

However, it is to be understood that the lottery accounting software of the present invention need not be run on handheld compute device 17-1. Rather, it should be noted that the lottery accounting software of the present invention could operate on any well-known programmable compute device, such as a laptop computer 17-2, a desktop computer 17-3 or even an online lottery ticket register (not shown), without departing from the spirit of the present invention.

It should be noted that by downloading the data collected by the handheld device onto a computer, more sophisticated software may be used to provide extensive lottery sales information for selected time periods, which is highly desirable. This information can also be used to track the sales history for selected clerks (i.e., to monitor against employee theft).

Overview of the Method for Managing Lottery Ticket Sales

Figure 2:
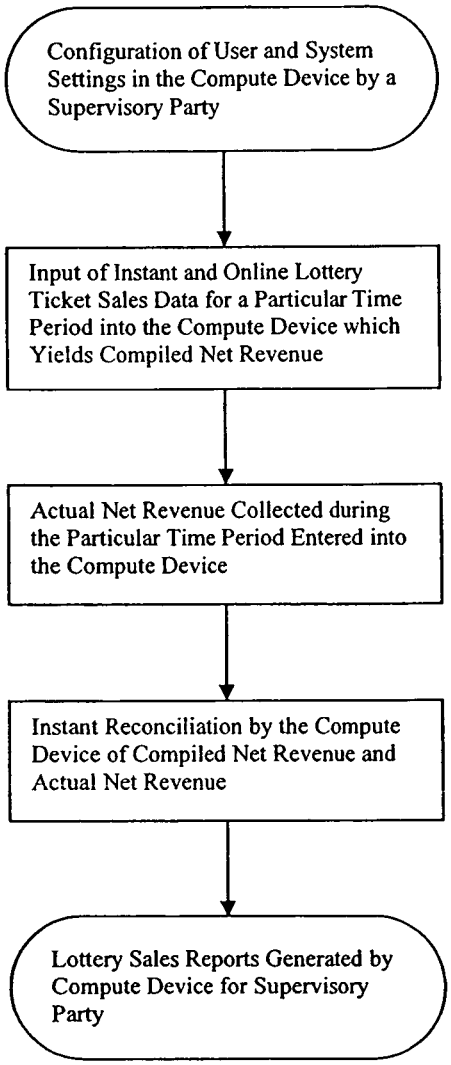
FIG. 2 is a simplified flow chart which depicts a method for managing both instant and online lottery ticket sales during a specified period of time using a programmable compute device of the type shown in FIG. 1, the method being constructed according to the teachings of the present invention.
Figure 3A:
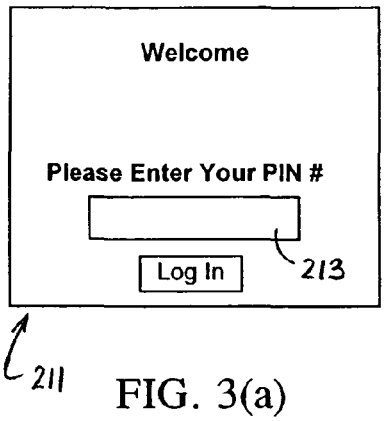
FIGS. 3(*a*)-(*h*) are a series of sample screen displays from a programmable compute device which are useful in understanding the configuration step shown in FIG. 2.
Figure 3B:
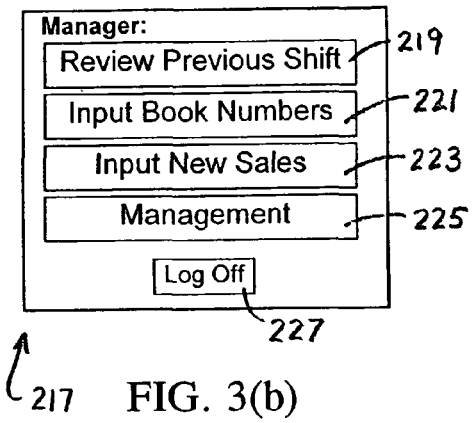
Figure 3C:
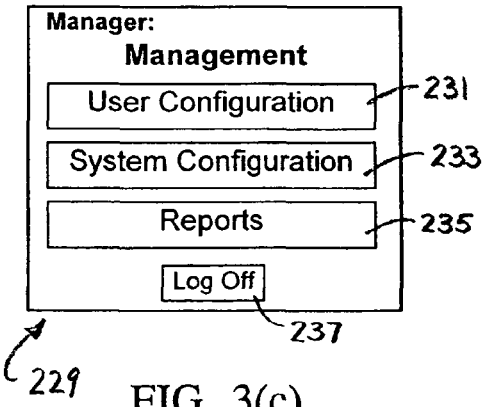
Figure 3D:
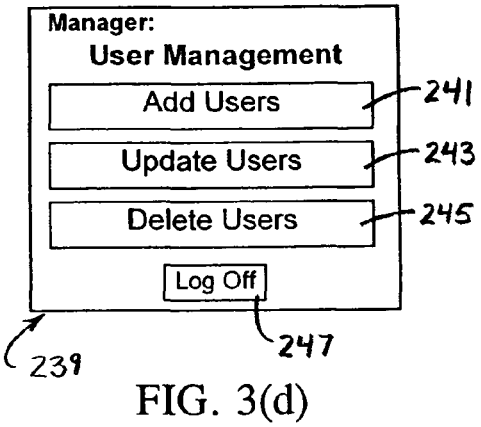
Figure 3E:
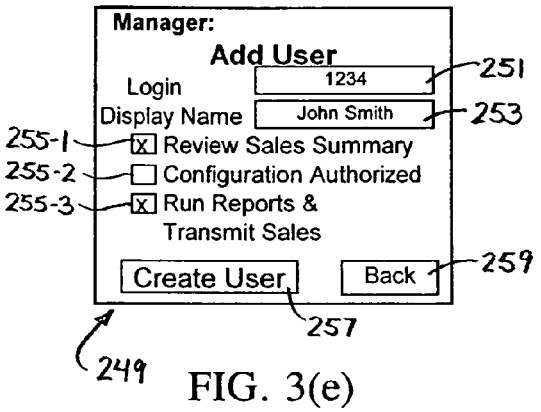
Figure 3F:
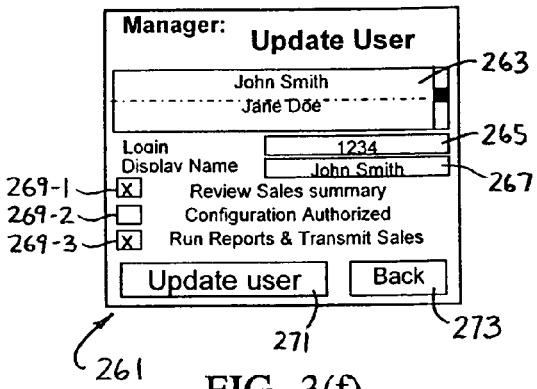
Figure 3G:
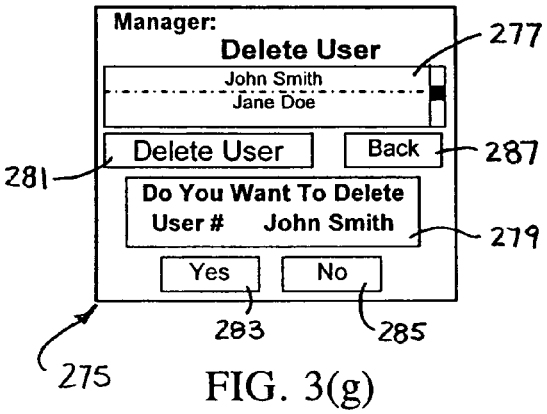
Figure 3H:
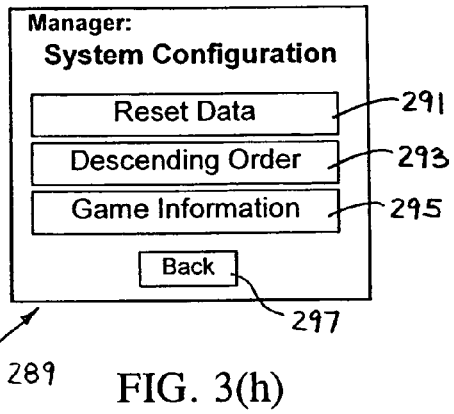
Figure 4A:
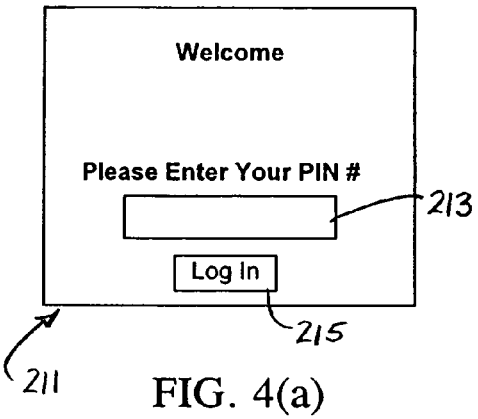
FIGS. 4(*a*)-(*l*) are a series of screen displays from a programmable compute device which are useful in understanding the data input and reconciliation steps shown in FIG. 3.
Figure 4B:
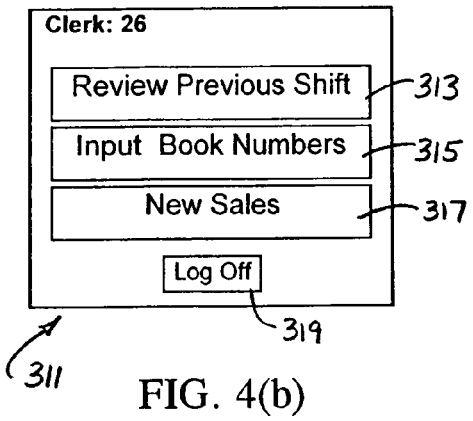
Figure 4C:
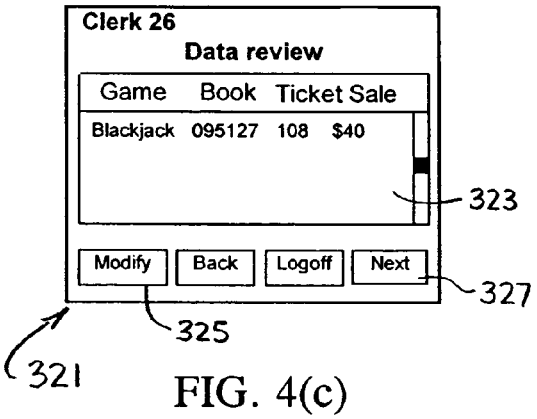
Figure 4D:
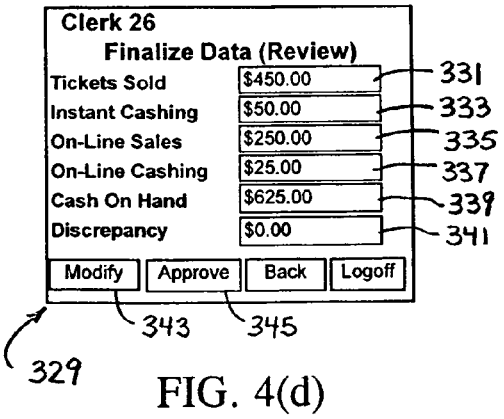
Figure 4E:
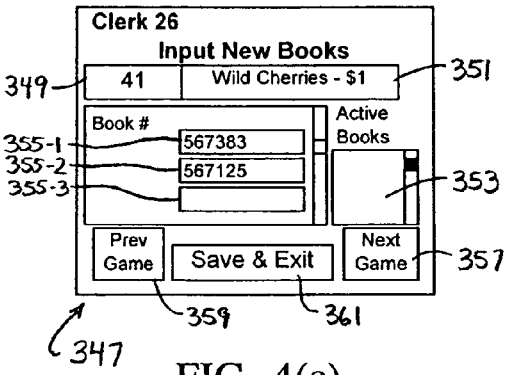
Figure 4F:
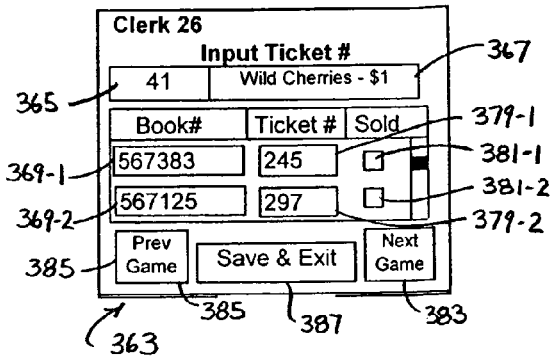
Figure 4G:
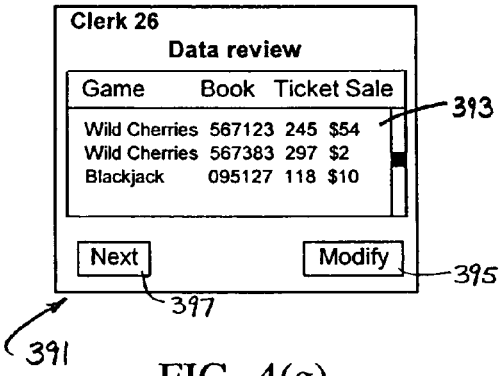
Figure 4H:
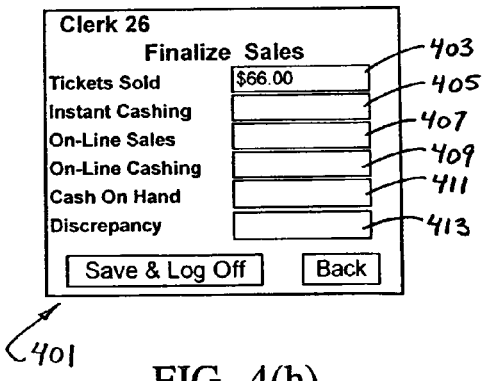
Figure 4I:
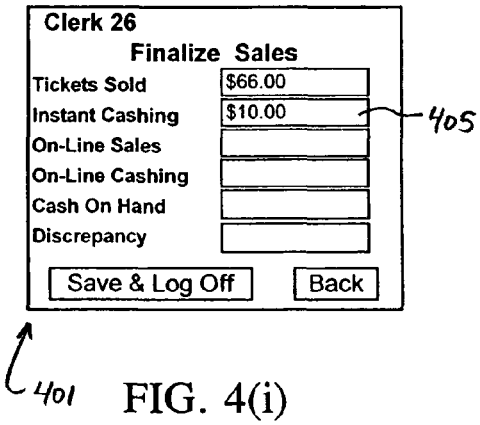
Figure 4J:
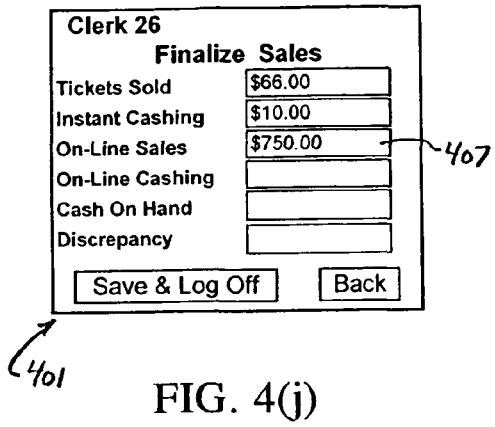
Figure 4K:
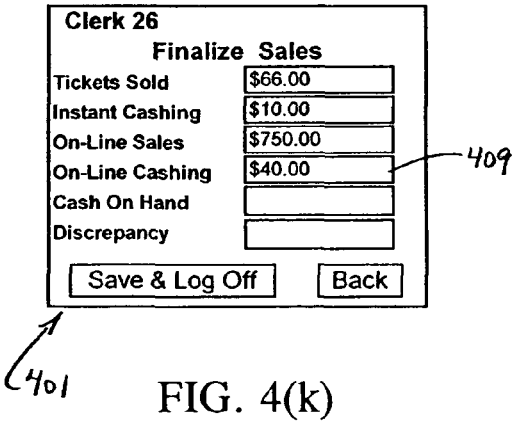
Figure 4L:
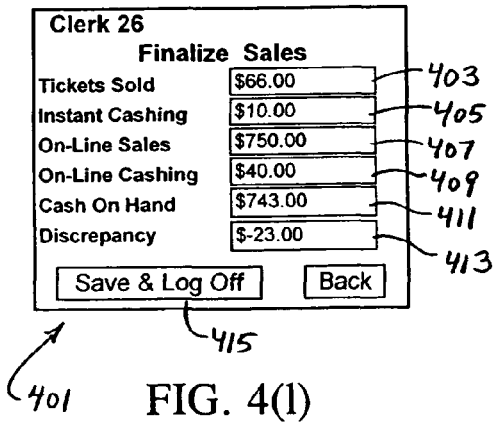

Referring now to FIG. 2, there is shown a simplified flow chart that is useful in understanding a novel method of managing both instant and online lottery ticket sales using compute device 17, the method being described according to the teachings of the present invention and identified generally by reference numeral 111. As noted above, a software program is preferably loaded on compute device 17 that facilitates execution method 111. In this manner, it is to be understood that compute device 17 eliminates the need for a lottery vendor 15 to maintain traditional, time-consuming, handwritten inventory logs, which is a principal object of the present invention.

As the first step in method 111, user and system settings for the accounting software running on compute device 17 are configured, this configuration step being identified generally by reference numeral 113. It is to be understood that the configuration of user and system settings is limited to managerial (i.e., supervisory) personnel for lottery vendor 15.

Upon completion of step 113, instant and online lottery ticket sales data for a particular time period (e.g., an employee shift) are input into compute device 17, this lottery sales data input step being identified generally by reference numeral 115. The sales data entered into compute device 17 preferably includes: (i) the total amount of instant lottery ticket sales made during the specified period, (ii) the total amount of winning instant lottery tickets redeemed during the specified period, (iii) the total amount of online lottery ticket sales made during the specified period and (iv) the total amount of winning online lottery tickets redeemed during the specified period. Upon receiving the sales data, the accounting software provided on compute device 17 instantaneously calculates the net revenue accumulated during the defined time period, this net revenue being referred to herein simply as the "calculated" or "compiled" net revenue.

With all lottery sales information input into compute device 17 in step 115, the actual net revenue collected during the defined period (i.e., the net amount of cash present in the vendor register at the end of the specified period) is entered into compute device 17, this entering step being identified generally by reference numeral 117. It should be noted that the net cash collected during the specified time period is referred to herein simply as the "actual" net revenue.

Once the actual net revenue is entered, the accounting software of the present invention instantly reconciles the calculated net revenue with the actual net revenue, this reconciliation step being identified generally by reference numeral 119. Any financial discrepancies ascertained during reconciliation step 119 are available for a supervisory party to review. Specifically, in step 121, the supervisory party can generate sales reports in order to investigate and/or discipline any employee who either accidentally or intentionally introduces a cash discrepancy.

Configuration of User and System Settings

As noted above, step 113 of method 111 relates to the configuration of user and system settings by a supervisory party. Referring now to FIGS. 3(*a*)-(*h*), there are shown a series of sample screen displays which are useful in understand the process by which a managerial party can modify user and system settings for the accounting software of the present invention.

Specifically, referring to FIG. 3(*a*) there is shown a login screen display that is provided by compute device 17, the login screen display being identified generally by reference numeral 211. Preferably, screen display 211 is the primary screen display generated by compute device 17 when the accounting software of the present invention is initialized.

Screen display 211 includes a pin number window 213 in which the supervisory party enters his/her unique identification code. Once entered, the supervisory party clicks on the login button 215 provided in display 211. Compute device 17 then verifies the authorization status of the unique identification code. If the identification code entered into window 213 corresponds to a managing party, the main screen display shown in FIG. 3(*b*) is retrieved for the manager, the main screen display being identified generally by reference numeral 217.

It is to be understood that access to main managerial screen display 217 is limited to pin numbers that correspond to supervisory personnel. In this manner, certain administrative functions (e.g., user and system configuration, shift reports, etc.) are only available to managing parties, which is highly desirable.

Main screen display 217 includes a previous shift review tab 219 for reviewing lottery sales data entered at the end of the previous time period, a book number input tab 221 for inputting the number of recently opened instant lottery ticket books into the accounting program, a new sales input tab 223 for inputting recent lottery sales data into the accounting program, a management tab 223 for performing selected management functions and a logoff tab 225 for exiting the accounting program.

Activation of management tab 225 retrieves the management screen display which is shown in FIG. 3(*c*) and identified generally by reference numeral 229. As can be seen, management screen display 229 is provided with a user configuration tab 231 for configuring the list of users authorized to operate the accounting program of the present invention, a system configuration tab 233 for configuring operational settings for the accounting program of the present invention, a reports tab 235 for generating various types of reports and a logoff tab 237 for exiting the accounting program.

In order to modify the list of authorized users, the manager is required to click on tab 231 which, in turn, retrieves the user configuration screen display shown in FIG. 3(*d*) and identified generally by reference numeral 239. As can be seen, screen display 239 is provided with an add user tab 241 for establishing a new authorized user of the accounting program, an update user tab 243 for modifying particular information relating to an existing authorized user of the accounting program, a delete user tab 245 for removing an existing authorized user from the list of authorize users (e.g., if a user is suspected of unscrupulous activity). As will be described in detail below, tabs 241, 243 and 245 provide the managing party with user-intuitive means for either adding, updating and/or deleting users from the principal user list archive stored on compute device 17.

As an example, activation of add user tab 241 retrieves the add user screen display shown in FIG. 3(*e*) and identified generally by reference numeral 249. As can be seen, screen display 249 is provided with a login window 251 into which is entered the pin number for the new user (e.g., 1234), a name window 253 into which is entered the name of the new user (e.g., John Smith) and a plurality of authorization windows 255-1, 255-2 and 255-3. By inserting a checkmark in a particular window 255 (e.g., by touching a window on the compute device touch screen with a stylus), the managing party effectively authorizes the new user to perform the particular task which corresponds with the window. Once the information relating to the new user has been completed by the managing party, the information is stored into the user list archives by activating the create user tab 257. Activation of a back button 259 returns the managing party back to user management screen 239 shown in FIG. 3(*d*).

As another example, activation of update user tab 243 retrieves the update user screen display shown in FIG. 3(*f*) and identified generally by reference numeral 261. As can be seen, screen display 261 is provided with a scrollable user list window 263 which displays all of the users stored in the user list archive (e.g., John Smith, Jane Doe). By highlighting a particular user on the list (e.g., John Smith), all of the information for the user is extracted from the user list archives and is displayed in login window 265, name window 267 and authorization windows 269-1, 269-2 and 269-3. Accordingly, it is to be understood that the information relating to the user can be directly modified and then stored back into the user list archives by clicking on an update user tab 271. Once completed, the managing party can return to user management screen 239 by clicking on a back button 273.

As yet another example, activation of delete user tab 245 retrieves the delete user screen display shown in FIG. 3(*g*) and identified generally by reference numeral 275. As can be seen, screen display 275 is provided with a scrollable user list window 277 which displays all of the users stored in the user list archive (e.g., John Smith, Jane Doe). By highlighting a particular user on the list (e.g., John Smith), information relating to the user is extracted from the user list archives and is displayed in information window 279. In order to delete the highlighted user, the managing party is required to click on a delete user tab 281. An optional pop-up screen may be provided upon activation of delete user tab 281 to confirm that the user is to be deleted, wherein confirmation is executed through the use of a yes tab 285 and a no tab 287. Once completed, the managing party can return to user management screen 239 by clicking on a back button 297.

Referring back to management screen display 229 shown in FIG. 3(*c*), it is to be understood that activation of system configuration tab 233 enables the managing party to configure operational settings relating to the accounting program of the present invention. Specifically, activation of system configuration tab 233 retrieves the system configuration screen display shown in FIG. 3(*h*) and identified generally by reference numeral 289. As can be seen, screen display 289 is provided with a reset data tab 291 for resetting all user and lottery sales data stored on compute device 17, a ticket order tab 293, a game information tab 295 and a back screen tab 297.

Ticket order tab 293 relates to establishing the order in which individual scratch tickets are to be dispensed from each instant ticket lottery book (i.e., front-to-back (in ascending ticket order) or back-to-front (in descending ticket order)). Accordingly, the status of tab 293 can be toggled between descending order (as shown in FIG. 3(*h*)) and ascending order (not shown) by activating tab 293. Although not described in detail herein, it is envisioned that the accounting program of the present invention could be designed to monitor the tickets sold within a particular book and, if appropriate, notify the user when tickets appear to be sold in the opposite order as designated by tab 293.

Input of Lottery Sales Data and Reconciliation with Actual Net Revenue

Step 115 of method 111 relates to the input of both instant and online lottery sales data into compute device 17. More specifically, the types of sales data that is entered into compute device 17 as part of step 115 include: (i) the total amount of instant lottery ticket sales made during the specified period, (ii) the total amount of winning instant lottery tickets redeemed during the specified period, (iii) the total amount of online lottery ticket sales made during the specified period, and (iv) the total amount of winning online lottery tickets redeemed during the specified period.

As will become apparent below, the input of instant ticket lottery sales data is accomplished by first verifying (i.e., reviewing) at the beginning of the specified time period that the ticket number of the next available instant lottery ticket for each open instant ticket book was properly input into compute device 17 at the end of the previous time period. At the end of the designated time period, the user then enters into compute device 17 the ticket number of the next available instant lottery ticket for each instant ticket book. Using data stored in compute device 17 (e.g., the price associated with each instant ticket lottery game, the number of tickets provided in a particular game book, the order in which tickets are dispensed from a book, etc.), the accounting software of the present invention is able to dynamically calculate the value of gross instant ticket sales made during the specified time period. It is to be understood that the above-identified process is considerably faster and easier to perform than the more traditional method of entering instant ticket sales data into a handwritten inventory log and, in a subsequent step, manually adding all the entries to derive a gross sales value.

Referring now to FIGS. 4(*a*)-(*h*), there are shown a series of sample screen displays which are useful in understanding the above-described process for compiling instant ticket lottery sales data for a specified period using compute device 17.

Specifically, at the commencement of the specified time period (e.g., at the beginning of a clerk shift), the responsible party (e.g., a vendor clerk) initializes the accounting software which in turn retrieves login screen display 211, as seen most clearly in FIG. 4(*a*). The user then enters his/her pin number in window 213 and activates login button 215. Accessing user archives, compute device 17 verifies the identification code and retrieves a main screen display for the particular user, the main screen display being shown in FIG. 4(*b*) and identified generally by reference numeral 311. As can be seen, screen display 311 includes a review tab 313 for verifying instant ticket sales data input into compute device 17 at the end of the previous time period, a book number tab 315 for inputting recently opened instant lottery ticket books into compute device 17, a sales tab 317 for entering instant lottery ticket sales data at the end of the designated time period and a logoff tab 319 for exiting the accounting program. It should be noted that display 311 additionally preferably identifies the name or identification number of the user in the upper left hand corner (e.g., clerk 26) to confirm proper input of the user's pin number.

At the beginning of the designated time period (e.g., at the commencement of an employee shift), the user is first required to review the instant ticket sales data entered at the end of the previous time period. Accordingly, it is preferred that tabs 315 and 317 be deactivated until the user verifies this data. Verification of this instant ticket sales data is accomplished by activating tab 313 which, in turn, retrieves the data review screen display which is shown in FIG. 4(*c*) and identified generally by reference numeral 321.

Data review screen display 321 includes a scrollable instant ticket list window 323 which displays the name, book number, next available ticket number and amount of total sales made during the previous time period for every open instant ticket book (i.e., every book with tickets available for sale by vendor 15). For example, in FIG. 4(*c*), the active instant ticket game "Blackjack" is displayed along with its book number (095127), the number of the next available ticket in the book (108) and the total amount of sales made during the previous time period of that game ($40). For simplicity purposes only, window 323 is shown displaying a single instant ticket book. However, it is to be understood that scrollable window 323 is capable of simultaneously displaying a large quantity of instant ticket game books (e.g., over 100 different books) to accommodate vendors 15 who offer customers a wide variety of different instant ticket games.

With review screen 321 retrieved, the user is required to confirm that the number of the next available ticket for every instant ticket book is accurately represented within window 323 (the game number, book number and ticket number being commonly provided on the back the game ticket for reference).

If certain information is inaccurate (e.g., the number of the next available ticket in a particular book), an authorized party is required to modify the data associated with the game highlighted within window 323 by clicking on a modify tab 325. Preferably, only a supervisor or the previous clerk is permitted to modify the data provided at the end of the previous time period.

Once the user has confirmed that all the instant lottery ticket sales data shown in window 323 is accurate, a next tab 327 is activated which, in turn, retrieves a finalize review data screen display which is shown in FIG. 4(*d*) and identified generally by reference numeral 329. At this time, the user is required to confirm all the sales data entered at the end of the previous time period, the lottery sales data being broken up as: (i) the total amount of instant ticket sales made during the previous time period (e.g., $450) which is displayed in a tickets sold window 331, (ii) the total amount of instant tickets cashed during the previous time period (e.g., $50) which is displayed in an instant ticket redemption window 333, (iii) the total amount of online lottery sales made during the previous time period (e.g., $250) which is displayed in an online sales window 335, (iv) the total amount of online tickets cashed during the previous time period (e.g., $25) which is displayed in an online ticket redemption window 337, and (v) the total amount of lottery-related cash present in the vendor register at the end of the previous time period (e.g., $625) which is displayed in a cash on hand window 339.

The accounting program then combines the gross sales (i.e., windows 331 and 335) and subtracts lottery redemptions (i.e., windows 333 and 337) therefrom to calculate a compiled net revenue figure (i.e., the true amount of cash that should be present in the register). The compiled net revenue is then subtracted by the actual net revenue (i.e., window 339) to yield a cash discrepancy value (e.g., $0) which is displayed in a cash discrepancy window 341.

With review screen 329 retrieved, the user is required to confirm that the values displayed in windows 331, 333, 335, 337 and 339 are correct. If any value is deemed incorrect, an authorized party is required to modify the entry by clicking on modify tab 343. Preferably, only a supervisor or the previous clerk is permitted to modify this data.

If the data listed on review screen 329 is deemed to be accurate, the user clicks on approval tab 345 which, in turn, returns the user to main screen 311 (with the data stored into memory). At this point in time, the user is free to commence all lottery-related sales (i.e., the clerk starts his/her shift).

At the conclusion of the specified time period, the user is required to complete the instant ticket data entry process. Specifically, referring back to main screen display 311 shown in FIG. 4(*b*), the user is first required to input into compute device 17 the number of any instant ticket books which were opened during the specified time period by clicking on input book tab 315.

Activation of book tab 315 retrieves a new book screen display which is shown in FIG. 4(*e*) and identified generally by reference numeral 347. Once retrieved, the user is required to enter the state-generated game number for the instant lottery game within a game number window 349. By entering the game number (e.g., 41) into game number window 347, the accounting software in turn retrieves the commonly associated name of the game (e.g., $1 Wild Cherries) from the instant ticket game archives and displays the name within a name window 351.

With an instant ticket game selected, the book numbers associated with active books (i.e., open books previously entered into the system) are listed within a scrollable active books window 353. In addition, a plurality of new book number windows 355-1, 355-2 and 355-3 are provided. It is to be understood that the user is required to enter the numbers of any books opened during the designated time period (e.g., 567383 and 567125) into windows 355.

It should be noted that the game number (e.g., 41) and book numbers (e.g., 567383 and 567125) may be either automatically captured (e.g., by scanning the combined game number and book number barcode provided by the state on the back of each ticket) or manually entered (e.g., using a keypad) into compute device 17. It is to be understood that automatic data capture is preferred in order to accelerate the data entry process.

Once the number of every newly opened book relating to a particular instant ticket game is entered into compute device 17, the user may input additional newly opened books into compute device 17 by clicking on next game tab 357 which, when activated, clears windows 349, 351, 353 and 355. The above-identified data entry process is then repeated until all newly opened books is entered into compute device 17, the user being able to review and modify the data entered with respect to each game by clicking on either next game tab 357 and/or previous game tab 359. Once the user is satisfied that all the data relating to newly opened books is properly entered, a save tab 361 is activated which both stores the data into the open instant ticket games archives and retrieves the input ticket number screen display which is shown in FIG. 4(*f*) and identified generally by reference numeral 363.

As can be seen in FIG. 4(*f*), the retrieval of screen display 363 additionally retrieves all previously stored information relating to the open instant ticket books, the information being displayed by game. Specifically, the number (e.g., 41) and the name (e.g., $1 Wild Cherries) of an active instant ticket game are automatically displayed within windows 365 and 367, respectively. It is also to be understood that all of the open book numbers associated with the game are displayed within a plurality of book number windows 369-1 and 369-2. At this time, the user is required to locate the number of the next available ticket for each book and enter that number into its corresponding ticket number window 379. For example, as represented in FIG. 4(*f*), 245 is the next available ticket in book number 567383 and, as such, is entered into ticket number window 379-1, which is located adjacent to book window 369-1. Similarly, 297 is the next available ticket in book number 567125 and, as such, is entered into ticket number window 379-2, which is located adjacent to book window 369-2. Preferably, the ticket number could be captured by compute device 17 either automatically (e.g., by barcode) or through manual data entry.

It should be noted that a plurality of sold windows 381-1 and 381-2 is provided adjacent to ticket number windows 379-1 and 379-2, respectively. As can be appreciated, if all the tickets for a particular book are sold during the designated time period, the sold window 381 for that book is activated (e.g., checked), thereby effectively closing the book from the active book archives.

It should also be noted that, on occasion, an instant ticket game is abruptly closed by the state gaming commission. In this situation, a vendor is required to immediately return all books relating to the game back to the gaming commission. Accordingly, although not shown herein, it is envisioned that another box could be designated for an open instant ticket book that signifies that the book has been prematurely closed (i.e., with tickets remaining in the book).

By activating the next game tab 383 and/or previous game tab 385, the user can skip to the screen designated for each instant ticket game. Once a desired game screen is retrieved, the number of every open book that relates to the game is listed. In a similar manner, the user is required to input the number of the next available ticket in every active book. Once all of the data has been entered, the user activates save button 387 which, in turn, stores the data into memory. Accordingly, all of the following data for every open book is input into the accounting program: (i) the number of the next available ticket at the beginning of the time period, (ii) the number of the next available ticket at the end of the time period, (iii) the price of each ticket and (iv) the order in which the tickets were dispensed (i.e., ascending or descending ticket order). Accordingly, the accounting program installed on compute device 17 is able to instantly calculate the exact number of tickets sold from each particular book during the specified time period and in turn multiply that number by the price value of each ticket. In this manner, the accounting software is able to instantly determine the gross revenues collected by the employee during his/her shift with respect to every active instant ticket book.

Activation of save button 387 simultaneously retrieves the instant ticket data review screen display shown in FIG. 4(*g*) and identified generally by reference numeral 391. Data review screen display 391 includes a scrollable instant ticket game list window 393 which displays the name, book number, next available ticket number and gross sales made during the specified time period for every active instant lottery ticket book. For example, in FIG. 4(*g*), the active instant ticket game "Blackjack" is displayed along with its book number (095127), the number of the next available ticket in the book (118) and the total amount of sales made during the particular time period of that game ($40). In addition, both newly opened books (567123 and 567383) for the instant ticket game "Wild Cherries" are displayed, each book listing the next available ticket in the book (245 and 297) as well as the total amount of sales made during the particular time period with respect to the book ($54 and $2).

For simplicity purposes only, window 393 is shown displaying three open instant lottery ticket books. However, it is to be understood that scrollable window 393 is capable of simultaneously displaying a large quantity of instant ticket games (e.g., 100 or more open instant ticket books) to accommodate vendors 15 who offer customers a wide variety of different instant ticket games.

With review screen 391 retrieved, the user is required to confirm that the number of the next available ticket for every open instant ticket book is accurately represented within window 393. If certain information relating to an open book is inaccurate (e.g., the number of the next available ticket in a particular book), the user is required to highlight the book within window 393 and click on a modify tab 395. In turn, a screen display 363 for the book will be retrieved with the improper information shown therein and available for modification. Upon completion of this correction process, the user is returned to review screen 391.

Once the user has confirmed that all the instant lottery ticket sales data shown in window 391 is accurate, a next tab 397 is activated which, in turn, retrieves a finalize sales screen display which is shown in FIG. 4(*h*) and identified generally by reference numeral 401. As can be seen, screen display 401 includes an instant ticket sales window 403, an instant ticket redemption window 405, an online ticket sales window 407, an online ticket redemption window 409, a cash collected window 411 and a cash discrepancy window 413. As will be described in detail below, screen display 401 provides automated means for reconciling all lottery-related sales and redemptions with the net cash collected by a vendor employee during a specified time period and, as such, serves as a principal novel feature of the present invention.

As seen in FIG. 4(*h*), the accounting software installed on compute device 17 automatically calculates the gross instant ticket sales made during the specified time period using the book sales data provided from review screen 391. For example, the instant ticket sales shown for each book listed on review screen 391 (i.e., $54, $2 and $10) are added together to yield a single gross instant ticket sales value for the specified time period. This calculated value (i.e., $66) is, in turn, automatically displayed within instant ticket sales window 403 in FIG. 4(*h*).

Having totaled the gross instant ticket sales, the user is the required to input the remainder of lottery-related sales data into compute device 17. Specifically, as seen most clearly in FIG. 4(*i*), the next step of the data entry process relates to the input of the total amount of instant ticket redemptions made during the specified time period (e.g., $10) in window 405. It is to be understood that the gross value of instant ticket redemptions made during the specified time period can be calculated either (i) by manually adding together the redemption value of all cashed instant tickets or (ii) by automatically capturing every cashed instant ticket into compute device 17 (e.g., using a barcode scanner) which in turn combines the redemption value of the tickets to yield a single gross instant ticket redemption amount which is input into window 405.

With the instant ticket sales data having been entered, the user is then required to enter into compute device 17 the amount of both (i) gross online ticket sales and (ii) total amount of online ticket redemptions made during the specified time period. It should be noted that both values are often readily retrievable from the register used to print the online tickets. As seen most clearly in FIG. 4(*j*), the total amount of online ticket sales made during the specified time period (e.g., $750) is input in window 407 of display screen 401. Furthermore, as seen in FIG. 4(*k*), the total amount of online ticket redemptions made during the specified time period (e.g., $40) is input in window 409 of display screen 401.

As can be appreciated, the accounting program of the present invention is designed to combine the instant and online ticket sale values provided in windows 331 and 335, respectively, to yield a gross lottery sales value for the specified time period. Similarly, the accounting program combines the instant and online ticket redemption values provided in windows 333 and 337, respectively, to yield a gross lottery redemptions value. By subtracting the value of the gross lottery redemptions from the value of the gross lottery sales, the accounting program of the present invention calculates the net revenue accumulated for all lottery related sales made during the specified time period, this net revenue being referred to herein simply as the "calculated" or "compiled" net revenue. As can be appreciated, the value of the compiled net revenue should be equal to the amount of lottery-related cash present in the vendor register at the end of the specified time period.

Having calculated the compiled net revenue in the manner set forth above, the accounting program of the present invention then reconciles that value with the actual net revenue collected during the specified period (i.e., the net amount of lottery-related cash present in the vendor register at the end of the specified period). It should be noted that the net amount of lottery-related cash collected during the specified time period is referred to herein simply as the "actual" net revenue.

Specifically, as seen most clearly in FIG. 4(*l*), the total amount of lottery-related cash collected during the specified time period (e.g. $743) is counted by the user and entered into window 411, as shown in FIG. 4(*l*). In turn, the accounting program of the present invention then automatically subtracts the actual net revenue from the compiled net revenue to yield a discrepancy value (e.g., −$23.00) which is dynamically displayed within window 413.

It is to be understood that, under ideal conditions, the compiled net revenue should equal the actual net revenue and, as a result, a zero discrepancy figure should be displayed within discrepancy window 413. However, it should be noted that various acts, whether unintentional (e.g., data entry mistakes, miscounting of actual revenue, etc.) and/or deliberate (e.g., employee theft), can result in a discrepancy value which is not equal to zero. If the discrepancy value is a negative number, a supervisory party reviewing screen 401 becomes instantly apprised of the exact amount of lottery-related cash that is missing at the end of the designated time period and, accordingly, can take appropriate actions to remedy the situation.

It should also be noted that a positive discrepancy value denotes a specific cash overage. To preclude an unscrupulous employee from adjusting the actual net revenue entry provided in window 411 and stealing the overage, the visual display of values provided in windows 403 and 413 may be limited to supervisory personnel. In this manner, a limited authorization user (e.g., a clerk) would be unaware of any cash overage and, as such, would be less inclined to steal from vendor 15 in this situation, which is highly desirable.

With all required data having been entered, screen display 401 is reviewed by the user. If the user confirms that all the values displayed are correct, a save button 415 is activated which, in turn, stores the lottery data for the specified time period into memory for the compute device 17. Furthermore, it is preferred that all lottery data be additionally transmitted from vendor 15 to system management bureau 13. In turn, a central database (not shown) electronically linked with server 19 is assigned to save all historical data collected by vendor 15, which is highly desirable for reasons to become apparent below.

Generation of Reports

As noted briefly above, historical data compiled using compute device 17 is stored either directly on compute device 17 or in a database located at system management bureau 13. This data in turn is available for retrieval by authorized personnel (e.g., a vendor manager) to generate a wide variety of lottery-related reports. Specifically, by activating reports tab 235 on screen display 229 shown in FIG. 3(*c*), a supervisory party is provided with user-intuitive means of generating reports that may be directed to, among other things, (i) sales made with respect to a particular lottery game, (ii) sales made by a particular vendor employee, (iii) sales made during a particular period of time, (iv) vendor shifts (i.e., which employee was on duty during a particular time period), and (v) game information (i.e., a comprehensive list of every game provided by the state, the list providing the name of each instant game, the code number associated with each game, the price of each game ticket and the fixed number of game tickets supplied in each instant game ticket book).

The embodiments shown in the present invention are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A method of managing both instant lottery ticket sales and online lottery ticket sales during a defined period of time using a programmable compute device, the method comprising the steps of:

(a) inputting into the compute device both instant lottery ticket sales data and online lottery ticket sales data for the defined period of time, (b) calculating with the compute device a compiled net revenue of both instant lottery ticket sales and online lottery ticket sales for the defined period of time by adding the instant lottery ticket sales data and the online lottery ticket sales data, (c) entering into the compute device an actual net revenue of instant lottery ticket sales and online lottery ticket sales collected during the defined period of time, and (d) reconciling with the compute device the compiled net revenue of instant lottery ticket sales and online lottery ticket sales for the defined period of time against the actual net revenue of instant ticket sales and online ticket sales collected during the defined period of time by subtracting the actual net revenue from the compiled net revenue to yield a discrepancy value.

2. The method of claim 1 wherein the calculation and reconciliation steps are automatically executed by the compute device.

3. The method of claim 2 wherein the instant and online lottery ticket sales data input into the compute device comprises:

(a) ticket information relating to one or more active instant lottery ticket books, (b) the total amount of online lottery ticket sales during the defined period of time, (c) the total amount of instant lottery ticket redemptions during the defined period of time, and (d) the total amount of online lottery ticket redemptions during the defined period of time.

4. The method of claim 3 wherein the compute device derives the total amount of instant lottery ticket sales during the defined period of time using the ticket information relating to the one or more instant ticket books.

5. The method of claim 4 wherein the process of deriving the total amount of instant ticket lottery sales during the defined period of time comprises the steps of:

(a) calculating the gross sales revenue generated from each of the one or more instant ticket books during the defined period of time, and (b) adding together the gross sales revenue generated from each of the one or more instant ticket books to yield the total amount of instant ticket lottery sales for the defined period of time.

6. The method of claim 5 wherein the step of calculating the compiled net revenue of instant and online lottery ticket sales for the defined period of time using the compute device is executed by subtracting the combined total amounts of instant and online lottery ticket redemptions from the combined total amounts of instant and online lottery ticket sales.

7. The method of claim 6 wherein the step of calculating the gross sales revenue generated from each instant ticket book comprises the steps of:

(a) inputting the number of the next available ticket in the instant ticket book into the compute device prior to commencement of the defined period of time, (b) inputting the number of the next available ticket in the instant ticket book into the compute device at the end of the defined period of time, (c) determining the difference in inputted ticket numbers to yield the total number of tickets sold from the book during the defined period of time, and (d) multiplying the total number of tickets sold during the defined period by the purchase price of each ticket in the instant ticket book to yield the gross sales revenue generated from the instant ticket book.

8. The method of claim 7 further comprising the step of configuring the compute device for use by selected personnel.

9. A lottery accounting system for managing both instant lottery ticket sales and online lottery ticket sales, the system comprising:

(a) a system management bureau, the system management bureau including a server, and (b) a plurality of lottery vendors, each lottery vendor located at a unique place of business and comprising a compute device in electronic communication with the server, each compute device being adapted to collect instant lottery ticket sales data and online lottery ticket sales data for a defined period of time, calculate a compiled net revenue of instant lottery ticket sales and online lottery ticket sales for the defined period of time by adding the instant lottery ticket sales data and the online lottery ticket sales data, receive an actual net revenue of instant lottery ticket sales and online lottery ticket sales collected during the defined period of time, and reconcile the compiled net revenue of instant lottery ticket sales and online lottery ticket sales for the defined period of time against the actual net revenue of instant ticket sales and online ticket sales collected during the defined period of time by subtracting the actual net revenue from the compiled net revenue to yield a discrepancy value.

10. The lottery accounting system of claim 9 wherein each compute device is adapted to electronically transmit data to the server.

11. The lottery accounting system of claim 10 wherein each compute device is adapted to wirelessly transmit data to the server.

12. The lottery accounting system of claim 9 wherein each compute device includes a scanner for automatic data entry.

13. The lottery accounting system of claim 9 wherein each compute device includes a keyboard and a touch screen for manual data entry.

* * * * *